US011299316B2

(12) United States Patent
Hsieh

(10) Patent No.: US 11,299,316 B2
(45) Date of Patent: Apr. 12, 2022

(54) SEPARATION STRUCTURE OF LOCK PACKING ASSEMBLY

(71) Applicant: TAIWAN FU HSING INDUSTRIAL CO., LTD., Kaohsiung (TW)

(72) Inventor: Wan-Lin Hsieh, Kaohsiung (TW)

(73) Assignee: Taiwan Fu Hsing Industrial Co., Ltd., Kaohsiung (TW)

( * ) Notice: Subject to any disclaimer, the term of this patent is extended or adjusted under 35 U.S.C. 154(b) by 232 days.

(21) Appl. No.: 16/458,386

(22) Filed: Jul. 1, 2019

(65) Prior Publication Data

US 2020/0354102 A1 Nov. 12, 2020

(30) Foreign Application Priority Data

May 8, 2019 (TW) ..... TW108205700

(51) Int. Cl.

| | |
|---|---|
| ***B65D 5/49*** | (2006.01) |
| ***B65D 5/468*** | (2006.01) |
| ***B65D 5/50*** | (2006.01) |
| ***B65D 71/68*** | (2006.01) |

(52) U.S. Cl.

CPC ..... *B65D 5/48032* (2013.01); *B65D 5/4608* (2013.01); *B65D 5/5038* (2013.01); *B65D 71/0077* (2013.01); *B65D 2571/0032* (2013.01); *B65D 2571/0045* (2013.01); *B65D 2571/00419* (2013.01)

(58) Field of Classification Search

CPC ..... B65D 71/0077; B65D 5/5038; B65D 5/48032; B65D 5/4608; B65D 2571/0032; B65D 2571/0045; B65D 5/5059

USPC ..... 206/192–198, 486, 562, 589; 229/120.24, 120.25, 120.26; 220/553–554, 528–531

See application file for complete search history.

(56) References Cited

U.S. PATENT DOCUMENTS

| | | | | | |
|---|---|---|---|---|---|
| 1,343,252 | A | * | 6/1920 | Downing | B65D 85/78 248/346.01 |
| 1,628,718 | A | * | 5/1927 | Fritzsche | B65D 85/78 206/589 |
| 1,812,311 | A | * | 6/1931 | Wolf | B65D 81/09 206/589 |
| 2,888,186 | A | * | 5/1959 | Meyers | B65D 5/48032 229/120.24 |
| 2,925,209 | A | * | 2/1960 | Wasyluka | B65D 5/48032 229/120.25 |

(Continued)

FOREIGN PATENT DOCUMENTS

TW M514454 U 12/2015

*Primary Examiner* — Chun Hoi Cheung

(74) *Attorney, Agent, or Firm* — Rosenberg, Klein & Lee

(57) ABSTRACT

A separation structure for a lock packing assembly includes a rectangular board with multiple holes which accommodate the handle of a lock, and the mounting plate of the lock contacts the board. The board includes a panel extending from each of four sides thereof, and the panels each have a first bending line and a second bending line. Each of the panels is bent along the first bending line and toward the board. Each of the panels is bent along the second bending line to form a separation plate which is perpendicular to the board and located between the holes. The locks are installed through the holes and separated by the separation plates such that the locks do not hit each other. The lock packing assembly includes low cost and can protect the locks.

6 Claims, 12 Drawing Sheets

(56) References Cited

U.S. PATENT DOCUMENTS 3,228,518 A * 1/1966 Coby ..... B65D 5/5038 206/562
3,317,111 A * 5/1967 Black ..... B65D 5/48034 229/120.26
3,682,597 A * 8/1972 Husch ..... G01N 33/03 422/408
3,702,170 A * 11/1972 Adams ..... B65D 5/48032 229/120.25
3,958,745 A * 5/1976 Lindsay ..... B65D 5/48034 229/120.26
3,963,171 A * 6/1976 Lindsay ..... B65D 5/48034 229/120.23
4,114,760 A * 9/1978 Entenmann ..... A21B 5/02 206/562
4,143,804 A * 3/1979 Visvydas ..... B65D 5/48034 229/120.26
4,379,518 A * 4/1983 Taylor, Sr. ..... B65D 5/4804 229/120.24
4,708,248 A * 11/1987 Davis ..... A45C 11/20 206/548
5,282,567 A * 2/1994 Dickson ..... B65D 5/4804 229/120.25
5,765,687 A * 6/1998 Matsubara ..... B65D 5/5038 206/521
5,842,568 A * 12/1998 Chang-wen ..... B65D 5/5038 206/419
5,899,353 A * 5/1999 Sabin ..... A21D 13/33 220/507
6,523,693 B1 * 2/2003 Eggenberger ..... B65D 5/5021 206/216
7,234,402 B2 * 6/2007 Olvey ..... B65D 19/0012 108/51.3
8,091,705 B1 * 1/2012 McCutchen ..... B65D 5/5061 206/486

* cited by examiner

SEPARATION STRUCTURE OF LOCK PACKING ASSEMBLY

BACKGROUND OF THE INVENTION

1. Fields of the Invention

The present invention relates to a separation structure for a lock packing assembly, and more particularly, to a flat board that is bent along multiple bending lines to form separation plates so as to prevent the locks from hitting each other in the packing assembly.

2. Descriptions of Related Art

The conventional packing assembly for locks is disclosed in Taiwanese Utility Model M514454, and is formed by folding the base so as to accommodate a single lock therein. Multiple packing assemblies are then collected and received in a large box which is convenient for transportation.

The base of the conventional packing assembly disclosed in Taiwanese Utility Model M514454 is formed by a single and bent sheet. However, the single and bent sheet can only accommodate one lock therein. Multiple bent sheets are required to form the base so as to accommodate multiple locks. This type of the conventional packing assembly requires a lot of packing material, processes of cutting, bending and assembling.

Yet another packing assembly includes a box in which a separation plate is received, and the separation plate is formed by multiple sub-plates to form multiple spaces for receiving the locks. However, these locks in the box are not properly positioned and secured, and there is no proper buffering design so that the locks hit each other during transportation due to vibration and shaking. Besides, the box is easily deformed and the locks in the box may also be damaged by unexpected external force.

The present invention intends to provide a lock packing assembly that eliminates the shortcomings mentioned above.

SUMMARY OF THE INVENTION

The present invention relates to a separation structure for a lock packing assembly, and the separation structure comprises a board which is a rectangular board and includes multiple holes. The holes are designed to accommodate the handle of a lock, and the mounting plate of the lock contacts the board. The board includes a panel extending from each of four sides thereof. The panels each have a first bending line and a second bending line. Each of the panels is bent along the first bending line and toward the board, and each of the panels is bent along the second bending line to form a separation plate which is perpendicular to the board and located between the holes.

Preferably, the holes of the board are located in the form of three rows and two columns. Each of the panels located corresponding to the rows of the holes is a first part. Each of the first parts is located corresponding to one of the holes that is located in a middle of the rows of the holes. The first parts each are located between two separation plates.

Preferably, each of the panels located corresponding to the columns of the holes is a second part. The length of each of the separation plates adjacent to the second part is equal to the length of the board that is located corresponding to the rows of the holes. The length of separation plates adjacent to the first part is smaller than a half of the length of the board that is located corresponding to the columns of the holes.

Preferably, the board includes two rows and two columns of the holes. The length of the separation plate is smaller a half of the length of the board that is located corresponding to the columns of the holes.

Preferably, the board includes three rows and three columns of the holes. Each of the panels includes a third bending line. Two adjacent separation plates are formed by bending along the third bending line. When each of the panels is bent toward the board and along the first, second and third bending lines, the panel and the separation plates partially enclose the hole located at a corner of the board.

Preferably, a separation member is a square frame which is located perpendicularly to the center of the board so as to enclose the hole that is located at the center of the board.

Preferably, the height of the panels and the height of the separation plates each are equal to or larger than the distance between the mounting plate and the distal end of the handle.

Preferably, the holes are round holes.

Preferably, a dividing member is composed of multiple plates and multiple slits, and the plates are inserted into the slits to form the dividing member. The dividing member includes separated rooms that are located corresponding to the holes and the handles. The dividing member and the separation plates are located on different surfaces of the board.

Preferably, a box includes a space defined therein. The bent board and the locks are accommodated in the space of the box.

The advantages of the present invention are to provide a separation structure for a lock packing assembly, wherein the boards are formed with holes, panels and separation plates, so that the boards are bent to form the separation plates to separate the holes. The cost for manufacturing the separation structure is reduced. Multiple locks are positioned by the holes and the separation plates, and the locks are divided from each other and do not hit each other to maintain good condition during processes of packing and transportation.

The present invention will become more apparent from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
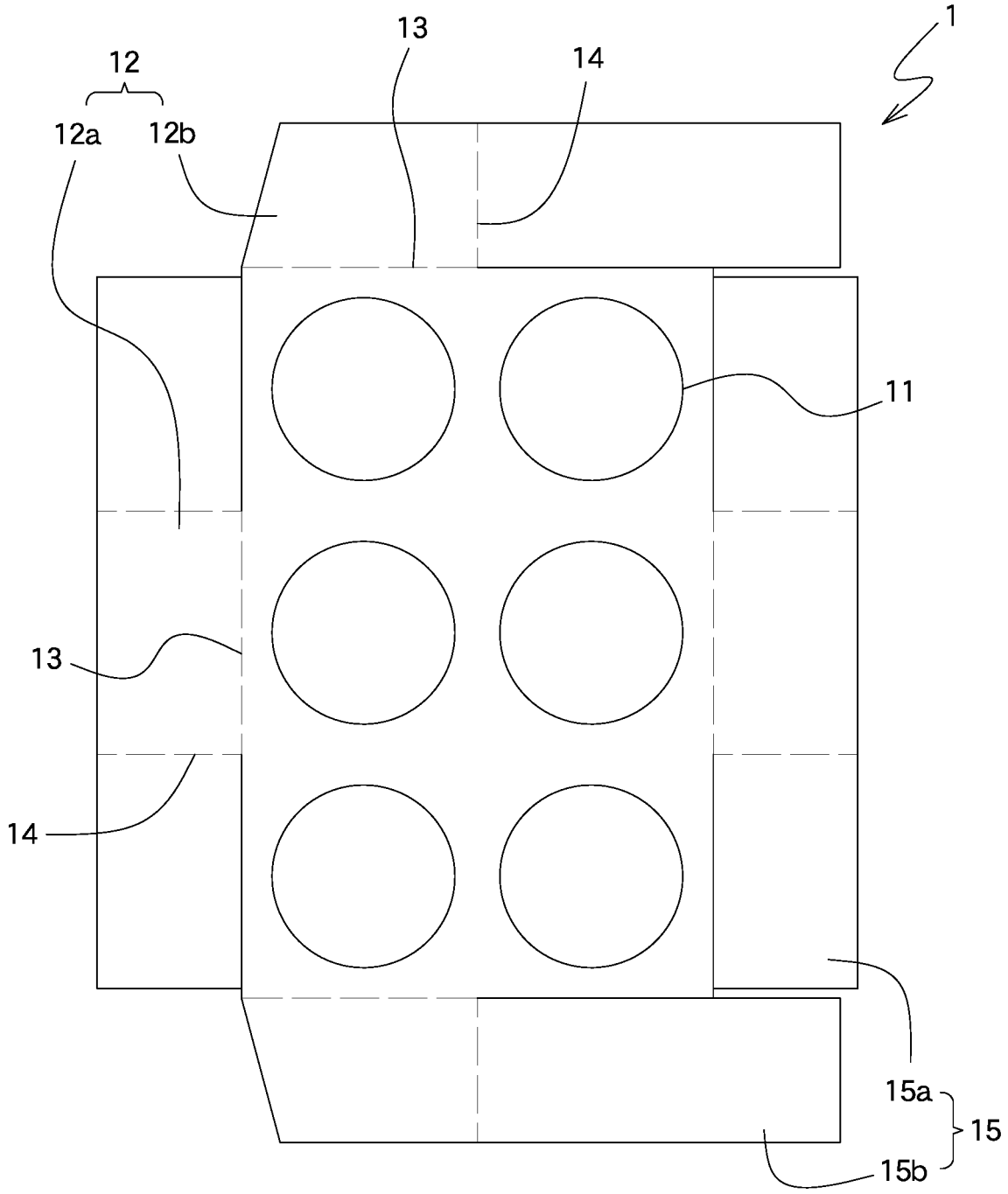
FIG. 1 shows the board with six holes of the present invention.
Figure 2:
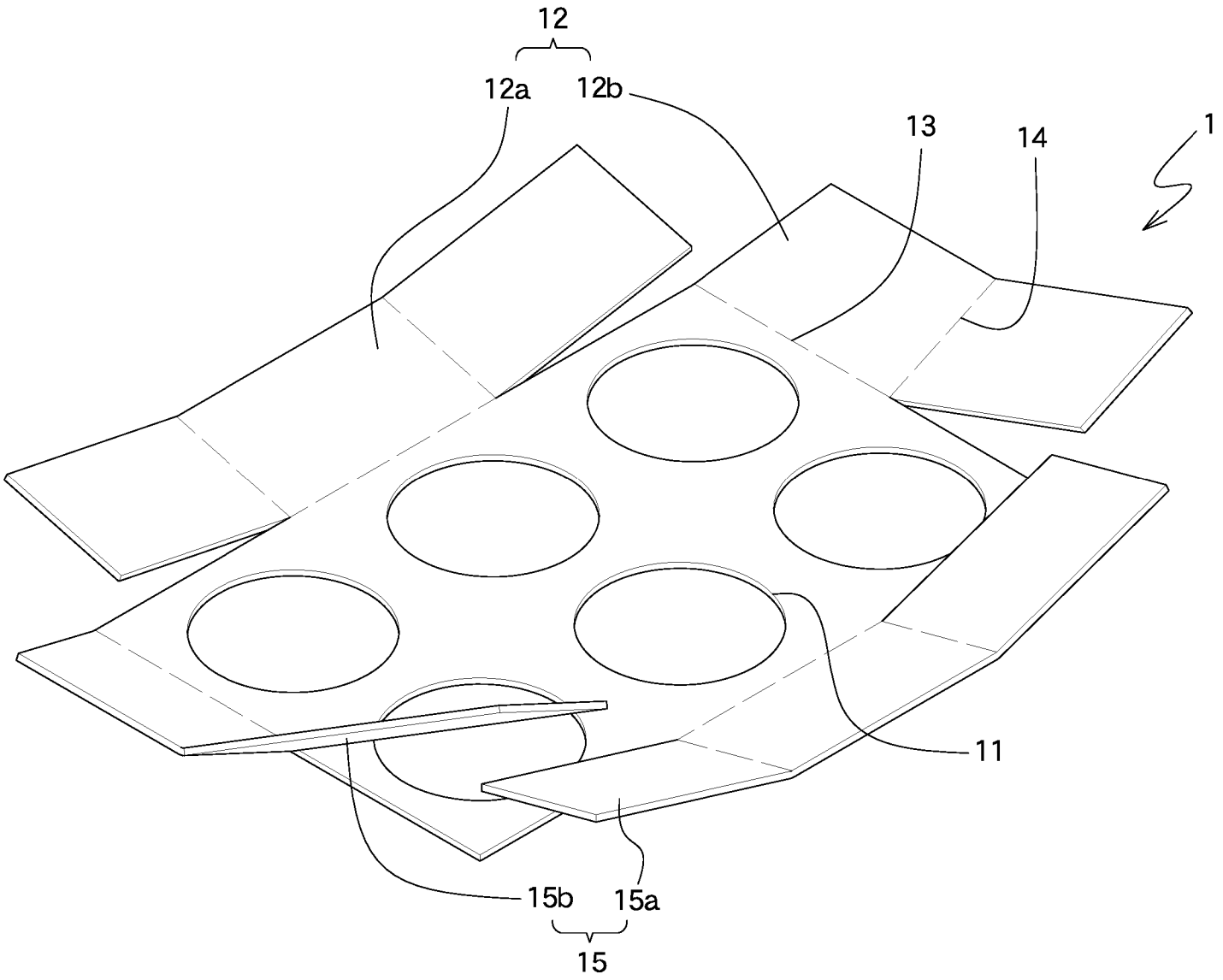
FIG. 2 shows that the panels each are bent along the first and second bending lines.
Figure 3:
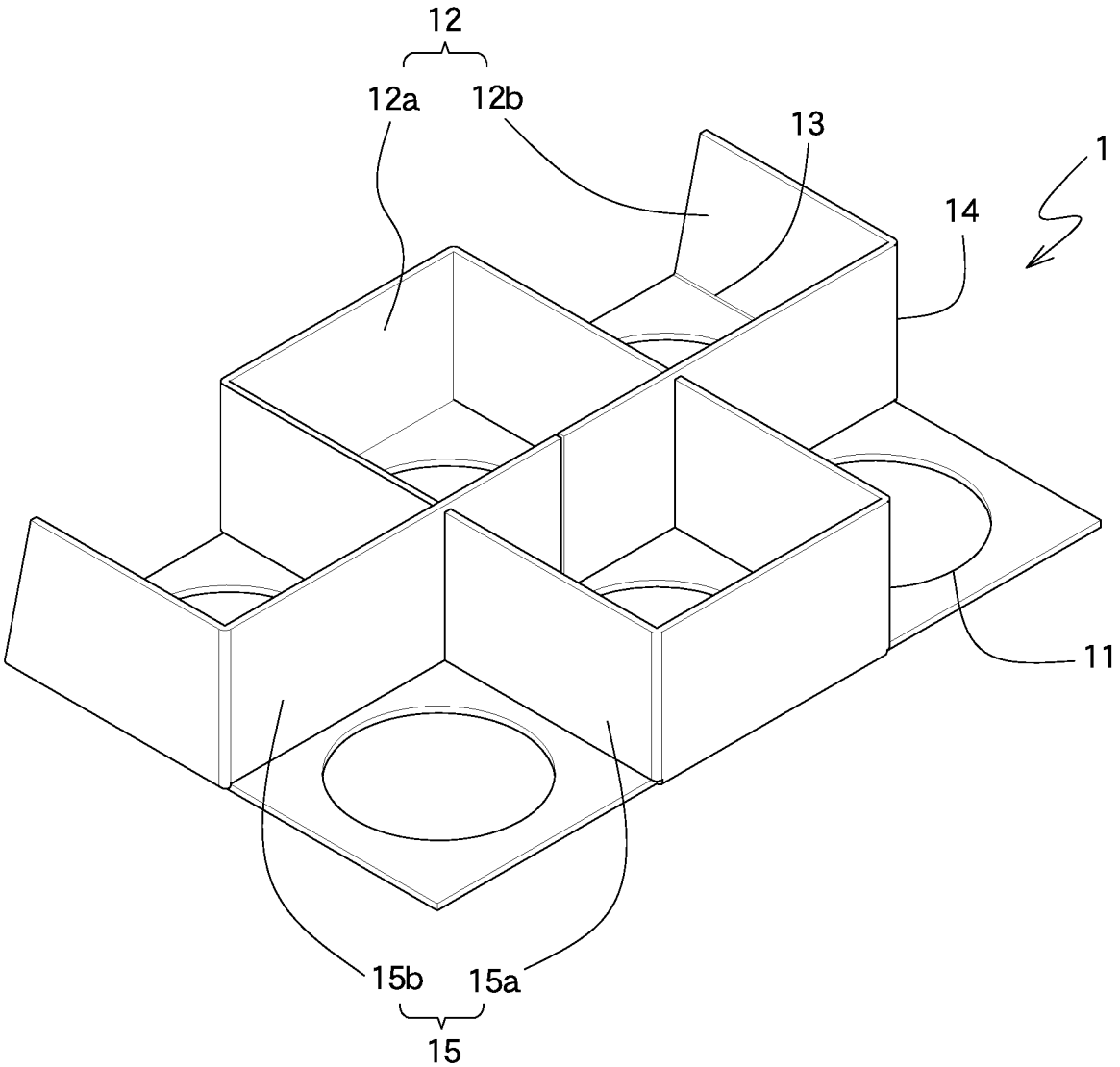
FIG. 3 is a perspective view to show that the panels of the board in FIG. 1 each are bent along the first and second bending lines.
Figure 8:
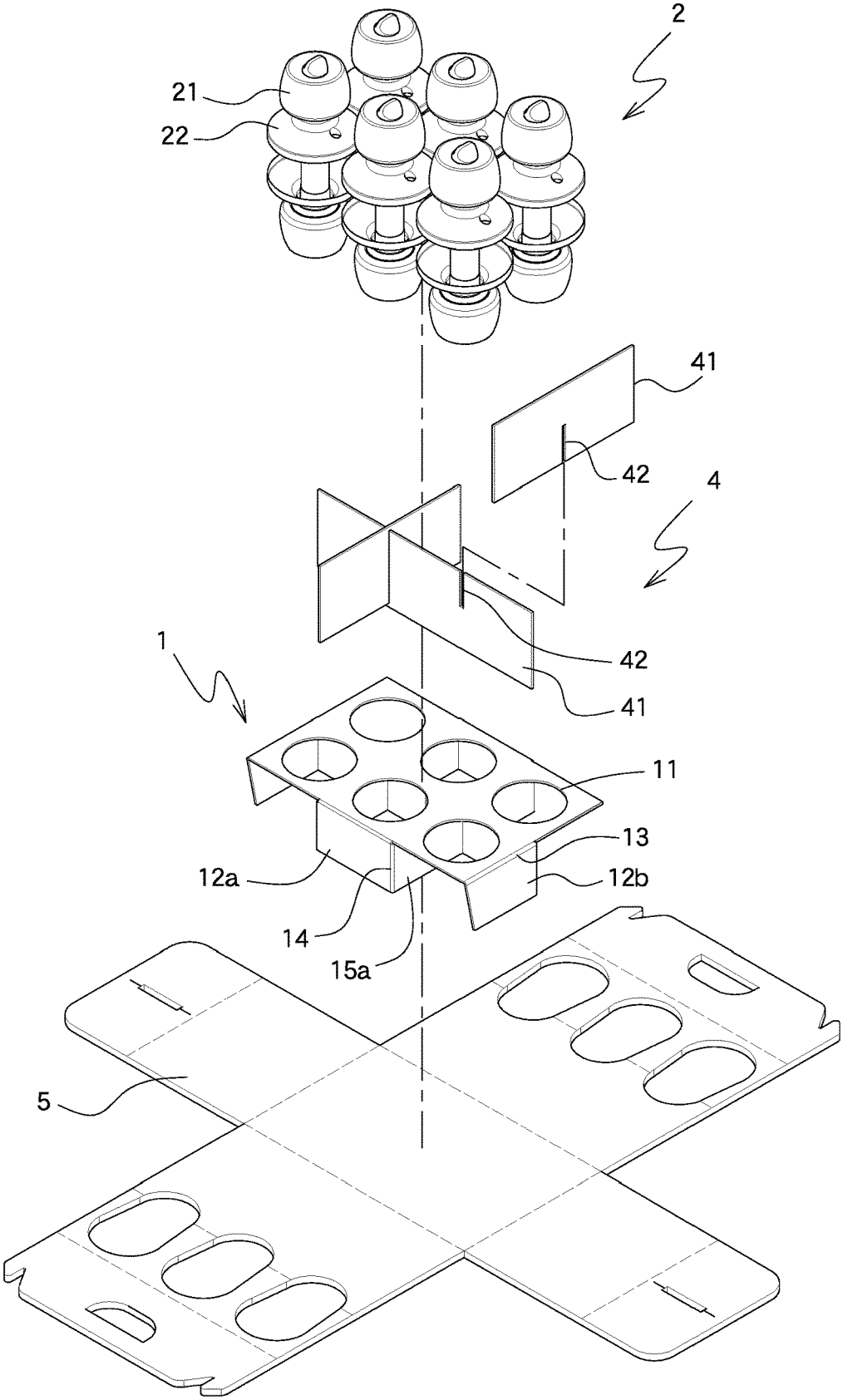
FIG. 8 is an exploded view to show the box, the board, the dividing member, and the locks.

Referring to FIGS. 1 to 3, the separation structure for a lock packing assembly of the present invention comprises a board 1 which is a rectangular board and includes multiple holes 11. The holes 11 of the board 1 are located in the form of columns and rows. The holes 11 are designed to accommodate the locks 2 as shown in FIG. 8, and the locks can be knob locks and cylindrical locks. The locks generally includes a handle 21 and a mounting plate 22. The handles 21 of the locks 2 extend through the holes 11, and the mounting plates 22 of the locks 2 contact the board 1. The board 1 includes a panel 12 extending from each of four sides thereof. The panels 12 each have a first bending line 13 and a second bending line 14. Each of the panels 12 is bent along the first bending line 13 and toward the board 1, and each of the panels 12 is bent along the second bending line 14 to form a separation plate 15 which is perpendicular to the board 1 and located between the adjacent holes 11. The boards 1 each are cut from a large board and the panels 12 and the separation plates 15 are integral to the board 1. The first and second bending lines 13, 14 are made during the formation of the boards 1. As shown in FIGS. 2 and 3, the panels 12 and the separation plates 15 each are bent along the first bending lines 13 and the second bending lines 14. The separation plates 15 are perpendicular to the board 1 and each are located between two of the holes 11. The locks 2 are positioned in the holes 11 of the board 1. The separation plates 15 separate the locks 2 which do not hit each other during transportation.

For the arrangement of the panels 12, in one embodiment, the panels 12 each are located corresponding to one of the holes 11 along one side of the board 1, and the second bending lines 14 are located between two adjacent holes 11, so that when the panels 12 and the separation plates 15 are respectively bent 90 degrees along the first and second bending lines 13, 14, the separation plates 15 are perpendicular to the board 1 and located corresponding between the two adjacent holes 11.

In one embodiment, when a lock packing assembly accommodates six locks 2, the holes 11 of the board 1 are located in the form of three rows and two columns. Each of the panels 12 located corresponding to the rows of the holes 11 is a first part 12*a*. Two first separation plates 15*a* extend from two sides of the first part 12*a*. Accordingly, when the first parts 12*a* and the first separation plates 15*a* are respectively bent 90 degrees along the first and second bending lines 13, 14, the separation plates 15*a* are perpendicular to the board 1 and located between the holes 11 in the middle and the two adjacent holes 11. Preferably, each of the panels 12 located corresponding to the columns of the holes 11 is a second part 12*b*. The combined length of the two second separation plates 15*b* respectively adjacent to the two second parts 12*b* is equal to the length of the board 1 that is located corresponding to the rows of the holes 11. Therefore, the two respective second separation plates 15*b* can be connected to each other. In order to prevent the first separation plates 15*a* adjacent to the first part 12*a* from interfering with the second separation plate 15*b* adjacent to the second part 12*b*, the length of the first separation plates 15*a* adjacent to the first part 12*a* is smaller than a half of the length of the board 1 that is located corresponding to the columns of the holes 11. By this arrangement, there will be a gap between the first separation plates 15*a*, and a second separation plate 15*b* is allowed to extend through the gap. As shown in FIG. 3, each of the separation plates 15 is located between the holes 11 to achieve the protection to the locks 2.

Figure 4:
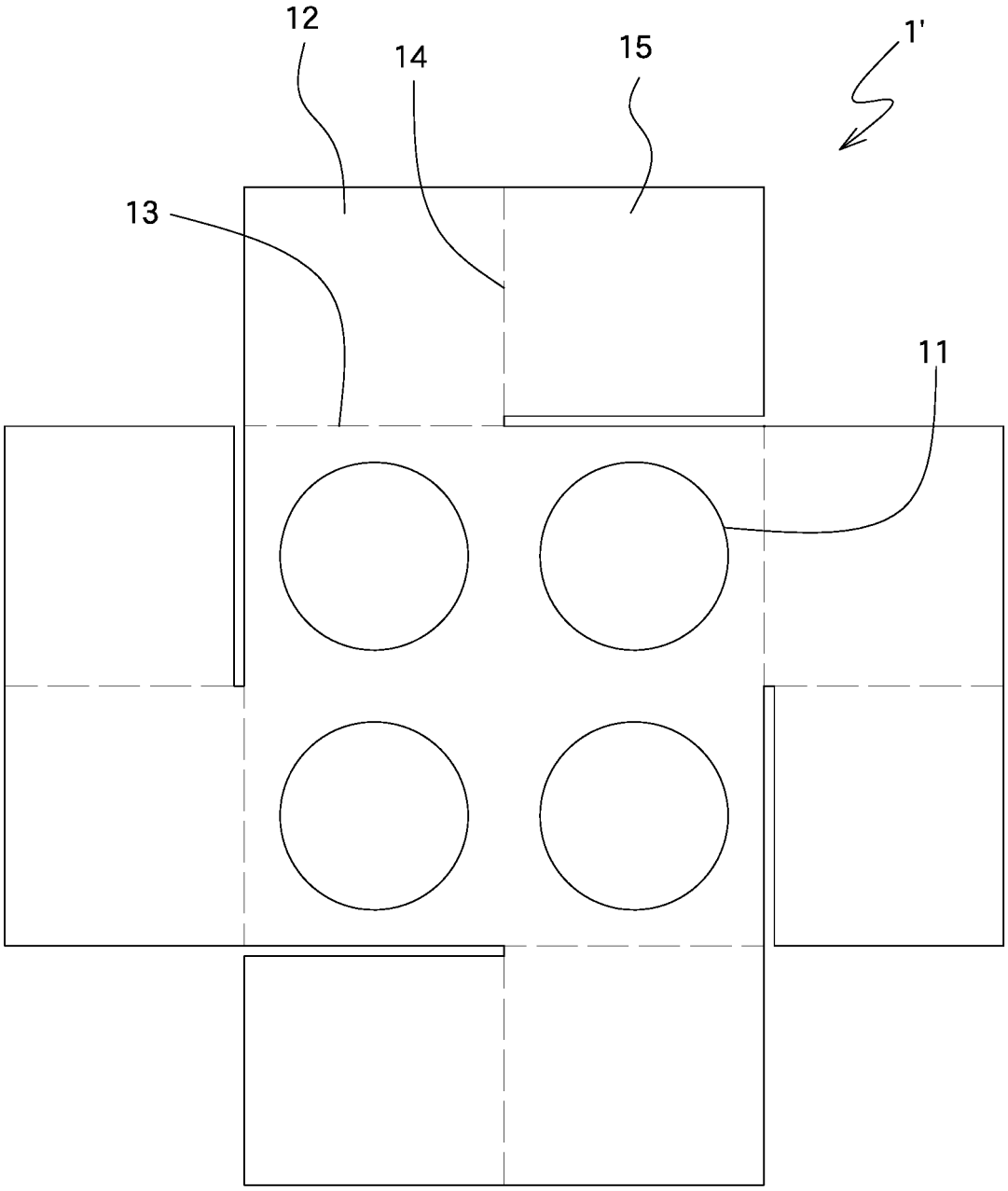
FIG. 4 shows the board with four holes of the present invention.
Figure 5:
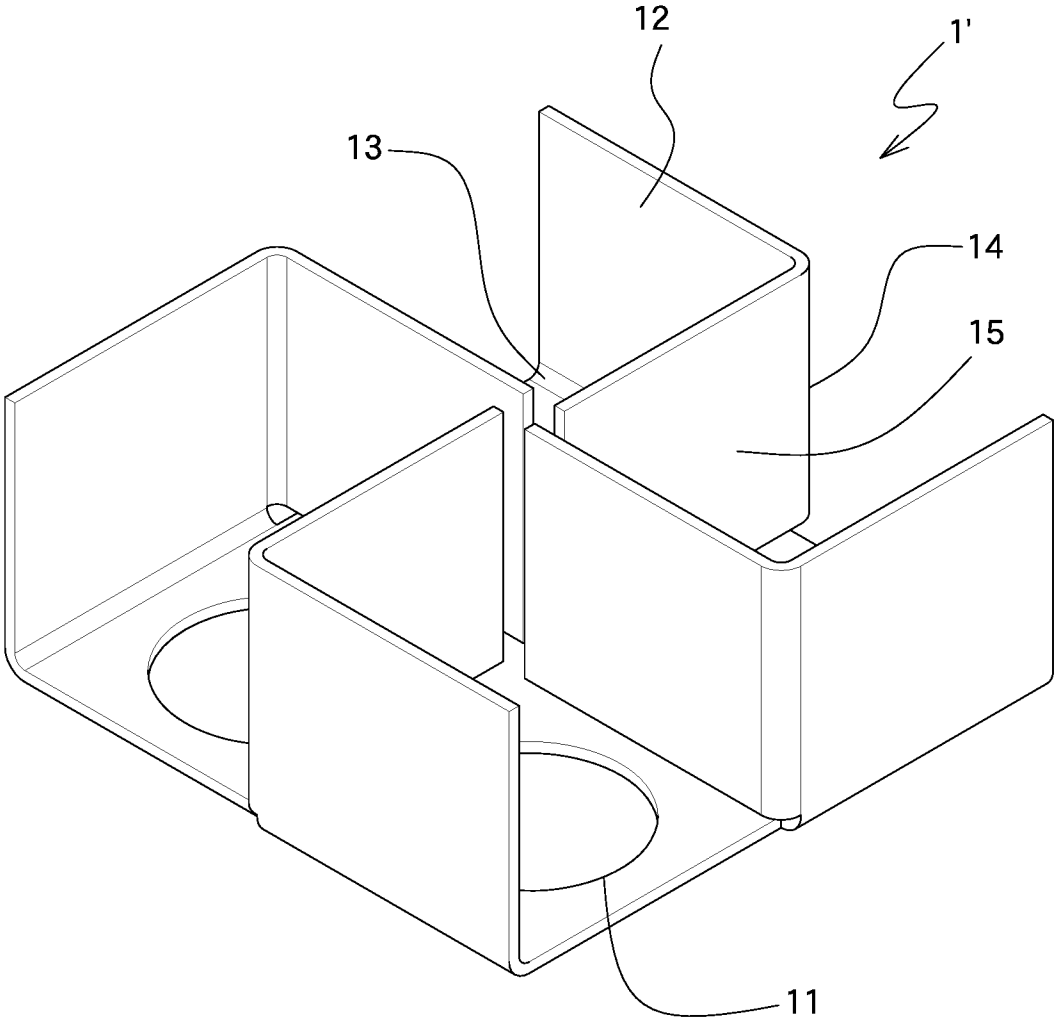
FIG. 5 is a perspective view to show that the panels of the board in FIG. 4 each are bent along the first and second bending lines.

In one embodiment, as shown in FIGS. 4 and 5, the board 1' includes two rows and two columns of the holes 11 so as to accommodate four locks 2. The length of the separation plate 15 is smaller than a half of the length of the board 1' that is located corresponding to the columns of the holes 11. Therefore, the separation plates 15 do not interfere with each other at the center of the board 1'.

Figure 6:
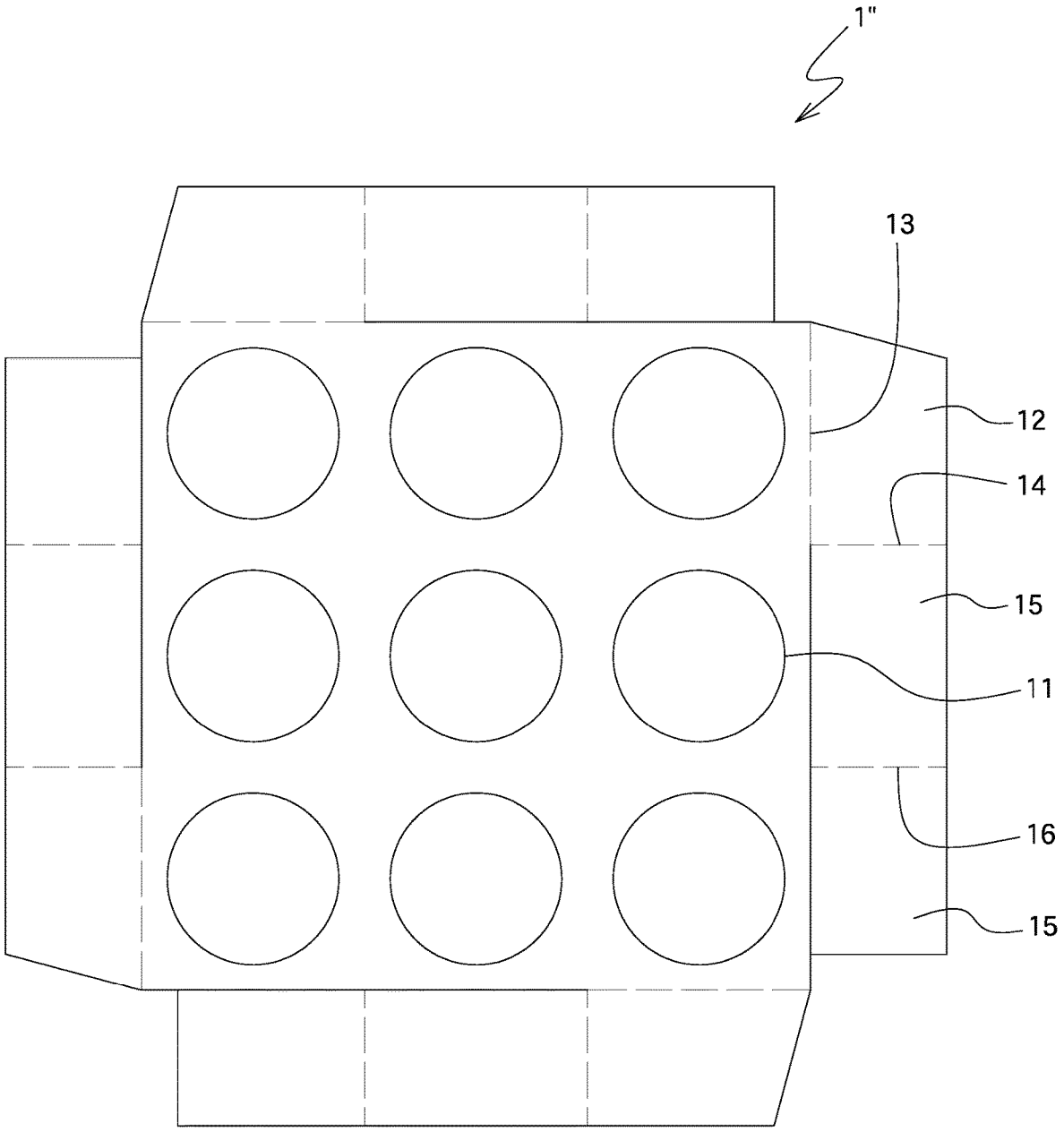
FIG. 6 shows the board with nine holes of the present invention.
Figure 7:
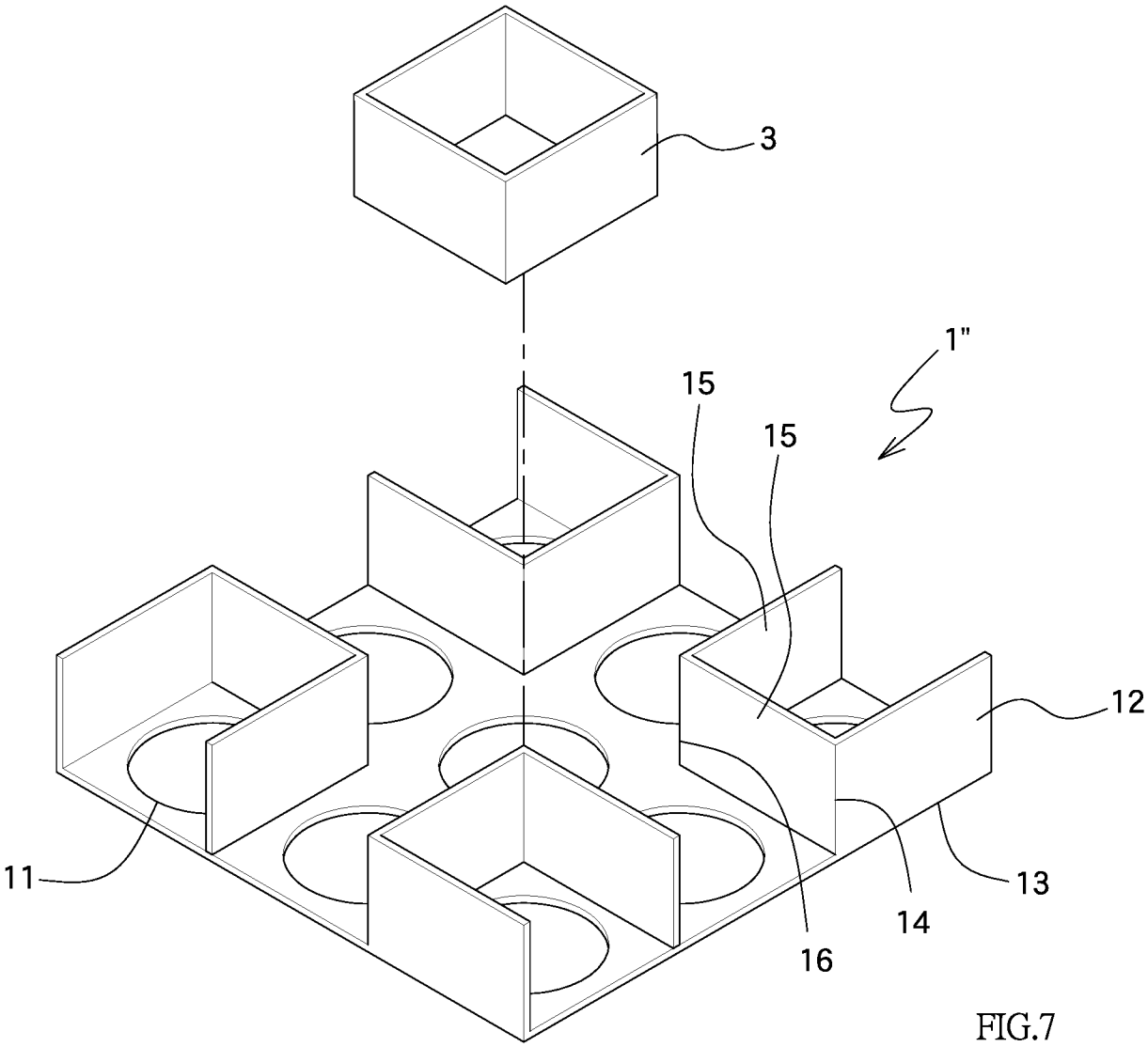
FIG. 7 is a perspective view to show that the panels of the board in FIG. 6 each are bent along the first and second bending lines, and a separation member is to be put on the board.

In one embodiment, as shown in FIGS. 6 and 7, the board 1" includes three rows and three columns of the holes 11 so as to accommodate nine locks 2. The panels 12 each are located corresponding to the hole 11 at the corner of the board 1". Two consecutive separation plates 15 extend from one side of each panel 12. A third bending line 16 is formed between the two separation plates 15. When the panel 12 and the separation plates 15 are bent 90 degrees respectively toward the board 1" and along the first bending line 13, the second bending line 14 and the third bending line 16, the panel 12 and the two consecutive separation plates 15 of each side of the board 1" partially enclose the hole 11 at the corner of the board 1". The hole 11 at the center of the board 1", and the four holes 11 that are located around the hole 11 at the center and located at a middle portion of each side of the board 1" are not separated by the separation plates 15. Preferably, a separation member 3 that is a square frame is located perpendicularly to the center of the board 1" so as to enclose the hole 11 that is located at the center of the board 1" such that the hole 11 at the center of the board 1" is separated from the four holes 11 located at the middle portion of the four respective sides of the board 1". By this arrangement, the locks 2 can be protected.

It is noted that when multiple locks 2 such as twelve locks 2 are required in one single packing assembly, multiple boards 1 as shown in FIGS. 1 to 3 can be folded and arranged side by side to achieve this purpose. If fifteen locks 2 are required in one single packing assembly, multiple boards 1" with nine holes 11 and multiple boards 1 with six holes 11 as disclosed before can be folded and arranged to achieve this purpose.

Figure 9:
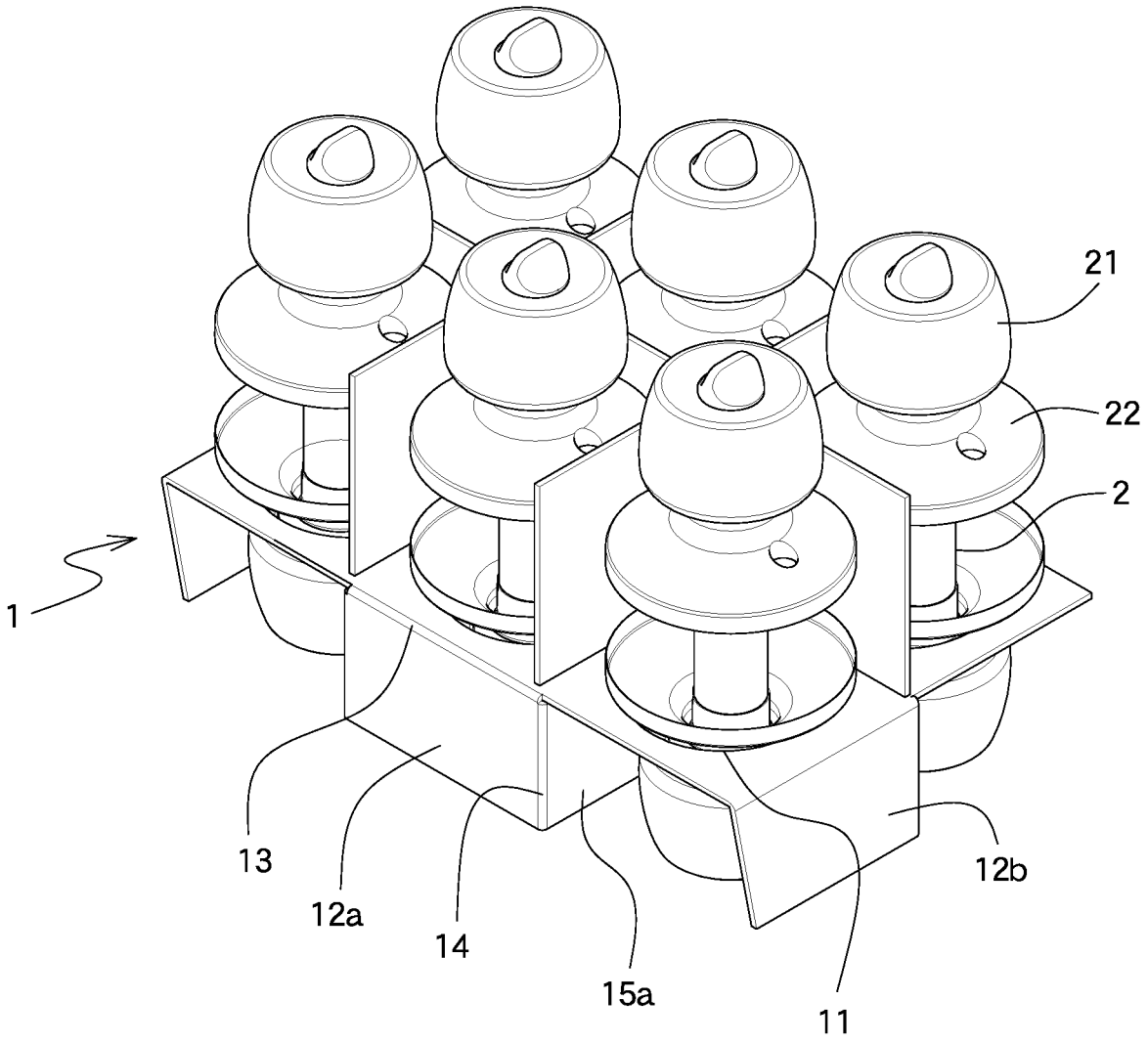
FIG. 9 shows that the locks are installed to the bent board.

As shown in FIGS. 8 and 9, the radial length of the handle 21 of the lock 2 is smaller than that of the holes 11, and the radial length of the mounting plate 22 of the lock 2 is larger than that of the holes 11. When the lock 2 axially extends through the hole 11, the mounting plate 22 contacts the board 1 to position the lock 2. Because the handle 21 and the mounting plate 22 are both round, the holes 11 are round holes.

When installing the locks to the board 1, the panels 12 and the separation plates 15 extend downward, and the handle 21 extends through the hole 11 from the top of the board 1 so that the handles 21 are separated by the separation plates 15 and protected by the separation plates 15 and the panels 12.

Figure 10:
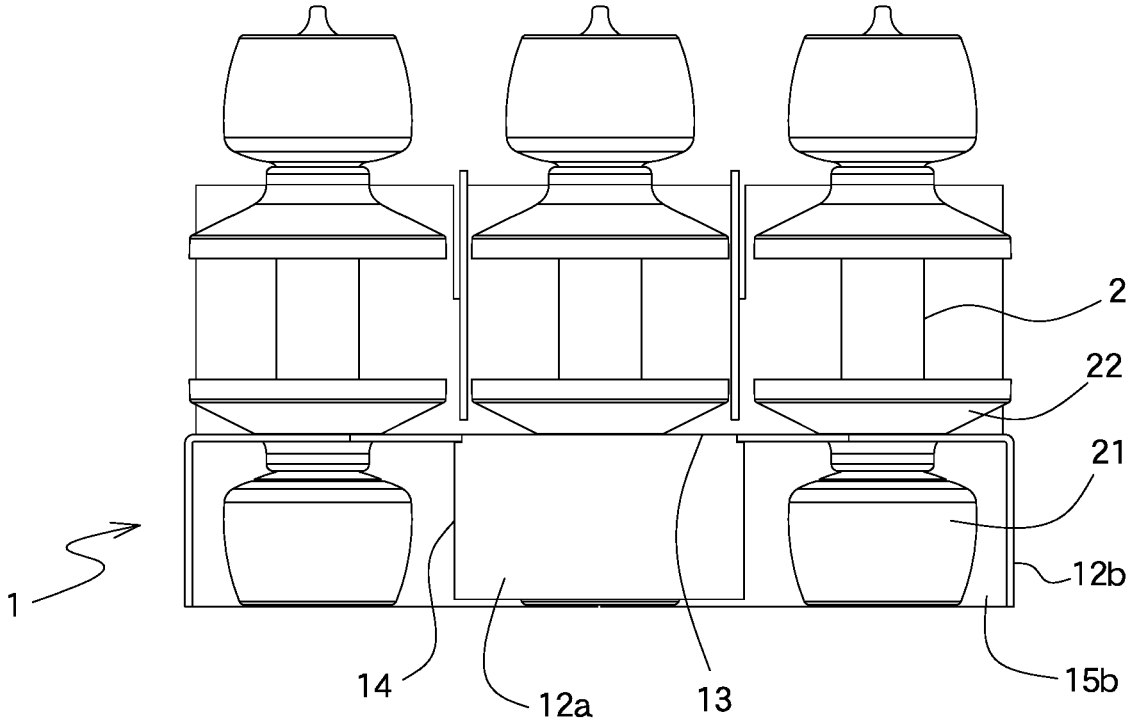
FIG. 10 is a side view of the disclosure in FIG. 9.
Figure 11:
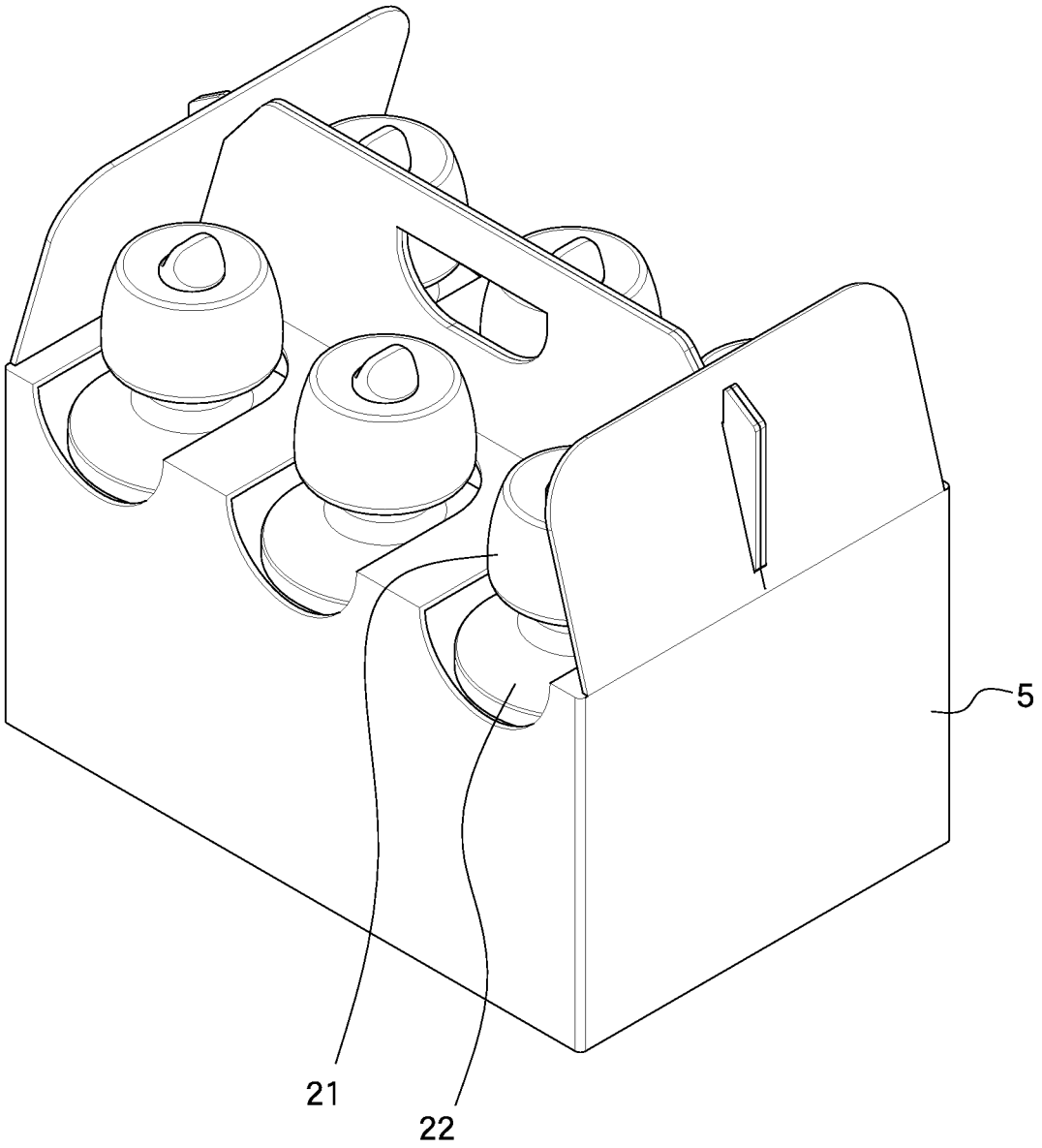
FIG. 11 shows that the combination of the locks and the bent board are put in the box.

The board 1 not only provides separation between the locks 2, the board 1 also provides buffering feature to protect the locks 2 from being hit due to impact. As shown in FIG. 10, the height of the panels 12 and the height of the separation plates 15 each are equal to or larger than the distance between the mounting plate 22 and the distal end of the handle 21. Therefore, the handles 21 of the locks 2 are supported and buffered regardless of the direction that the panels 12 and the separation plates 15 extend.

As shown in FIGS. 8 and 10, two handles 21 of each of the locks 2 can cooperate with two boards 1. In one embodiment, a dividing member 4 is composed of multiple plates 41 and multiple slits 42, and the plates 41 are inserted into the slits 42 to form the dividing member 4. The dividing member 4 includes separated rooms that are located corresponding to the holes 11 and the handles 21. The dividing member 4 and the separation plates 15 are located on different surfaces of the board 1. One of the two handles 21 of the lock 2 is installed to the hole 11, and the other handle 21 is located within the separated room of the dividing member 4.

Figure 12:
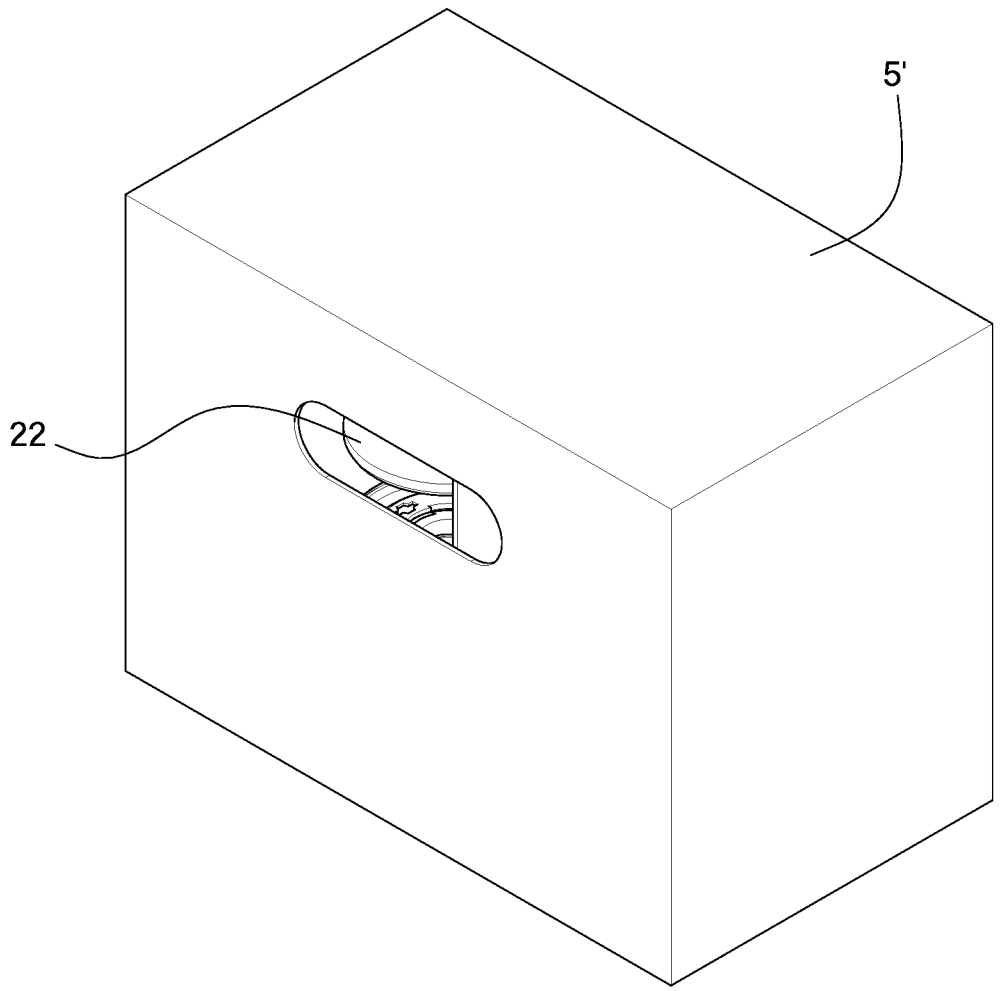
FIG. 12 shows that the combination of the locks and the bent board are put in another box.

As shown in FIGS. 8 to 11, a box 5 is provided and includes a space defined therein. The bent board 1 and the locks 2 are accommodated in the space of the box 5. The box 5 includes a grip portion and can be folded and portable. In another embodiment, as shown in FIG. 12, the box 5' may also include slots for easy carry.

While we have shown and described the embodiment in accordance with the present invention, it should be clear to those skilled in the art that further embodiments may be made without departing from the scope of the present invention.

What is claimed is:

1. A separation structure for a lock packing assembly, comprising:

a rectangular board having a plurality of holes arranged in three rows and two columns, the holes each adapted to accommodate a handle of a lock, the board adapted to contact a mounting plate of a lock accommodated in one of the holes, a plurality of panels respectively extending from each of four sides of the board, the panels each having a first bending line and a second bending line, each of the panels being bent along the first bending line and toward the board, each of the panels being bent along the second bending line to form a separation plate which is perpendicular to the board and located between the holes, wherein each panel extending from one of the sides of the board corresponding to the rows of the holes is a first part, each of the first parts being located corresponding to one of the holes in a middle row of the three rows of the holes, each first part having two first separation plates extending from opposite sides thereof, a length of each first separation plate being smaller than a half of a length of one of the sides of the board corresponding to the columns of the holes, and wherein each panel extending from one of the sides of the board corresponding to the columns of the holes is a second part, each second part having a second separation plate extending therefrom, each second separation plate extending through a gap formed between a pair of first separation plates.

2. The separation structure for a lock packing assembly as claimed in claim 1, wherein a height of the panels and a height of the separation plates each are adapted to be equal to or larger than a distance between the mounting plate of a lock and a distal end of the handle of the lock.

3. The separation structure for a lock packing assembly as claimed in claim 1, wherein the holes are round holes.

4. The separation structure for a lock packing assembly as claimed in claim 1, further comprising a dividing member including multiple plates and multiple slits, the plates being inserted into the slits to form the dividing member, the dividing member defining separated rooms, each room being located corresponding to one of the holes of the board, each room adapted to contain a handle of a lock positioned within the corresponding hole, wherein the dividing member and the separation plates are located on different surfaces of the board.

5. A lock packing assembly, comprising:

the separation structure as claimed in claim 1 and a box defining a space therein which accommodates the separation structure.

6. A separation structure for a lock packing assembly, comprising:

a rectangular board having a plurality of holes arranged in three rows and two columns, the holes each adapted to accommodate a handle of a lock, the board adapted to contact a mounting plate of a lock accommodated in one of the holes, a plurality of panels respectively extending from each of four sides of the board, the panels each having a first bending line and a second bending line, each of the panels being bent along the first bending line and toward the board, each of the panels being bent along the second bending line to form a separation plate which is perpendicular to the board and located between the holes, wherein each panel extending from one of the sides of the board corresponding to the rows of the holes is a first part, each of the first parts being located corresponding to one of the holes in a middle row of the three rows of the holes, each first part having two first separation plates extending from opposite sides thereof, and wherein each panel extending from one of the sides of the board corresponding to the columns of the holes is a second part, each second part having a second separation plate extending therefrom, a combined length of the second separation plates being equal to a length of one of the sides of the board corresponding to the rows of the holes, a length of each first separation plate being smaller than a half of the length of one of the sides of the board corresponding to the columns of the holes.

* * * * *